US011130150B2

(12) United States Patent
Welch

(10) Patent No.: US 11,130,150 B2
(45) Date of Patent: Sep. 28, 2021

(54) DRIP-FREE ELECTRIC MATERIAL DISPENSING DEVICE

(71) Applicant: Welshire Holdings, LLC, La Crescent, MN (US)

(72) Inventor: John W. Welch, La Crescent, MN (US)

(73) Assignee: WELSHIRE HOLDINGS, LLC, La Crescent, WI (US)

( * ) Notice: Subject to any disclaimer, the term of this patent is extended or adjusted under 35 U.S.C. 154(b) by 0 days.

(21) Appl. No.: 17/060,968

(22) Filed: Oct. 1, 2020

(65) Prior Publication Data

US 2021/0094063 A1 Apr. 1, 2021

Related U.S. Application Data

(60) Provisional application No. 62/908,670, filed on Oct. 1, 2019.

(51) Int. Cl.
*B05C 17/01* (2006.01)
*B05C 17/005* (2006.01)

(52) U.S. Cl.
CPC ..... *B05C 17/014* (2013.01); *B05C 17/00576* (2013.01); *B05C 17/00593* (2013.01); *B05C 17/012* (2013.01); *B05C 17/0136* (2013.01)

(58) Field of Classification Search
CPC ..... B05C 17/014; B05C 17/00576; B05C 17/00593; B05C 17/012; B05C 17/0136
See application file for complete search history.

(56) References Cited

U.S. PATENT DOCUMENTS 4,260,076 A * 4/1981 Bergman ..... B05C 17/0103 222/327
4,615,469 A 10/1986 Kishi et al.
7,073,691 B2 7/2006 Rumrill et al.
8,528,785 B2 9/2013 Naughton
9,039,557 B2 * 5/2015 Naughton ..... B05C 17/0103 475/149
2004/0045982 A1 * 3/2004 Herman ..... B05C 17/00553 222/145.5

(Continued)

*Primary Examiner* — Jeremy Carroll
(74) *Attorney, Agent, or Firm* — Patterson Thuente Pedersen, P.A.

(57) ABSTRACT

An electrically powered handheld dispensing device used to dispense viscous materials from a cartridge in a drip-free manner. The dispensing device having a cartridge locking mechanism that affirmatively locks a material cartridge in place, limiting its axial motion in the cartridge holder. The dispensing device having a plunger assembly containing dogs that bite into the inner surface of the material cartridge piston after a plunger makes contact with the material cartridge piston. The dispensing device having a motor control circuit that automatically reverses the drive motor at high speed to reverse the piston inside the material cartridge to a predetermined distance when the user releases the trigger control, which may also suck material back from the cartridge nozzle tip preventing drips. A manually operated gear-release mechanism disengages the plunger assembly from the gear drive transmission, enabling rapid movement of the plunger in either direction for the loading or unloading of full or partially expended material cartridges.

20 Claims, 16 Drawing Sheets

(56) References Cited

U.S. PATENT DOCUMENTS

| | | | | |
|---|---|---|---|---|
| 2012/0118913 | A1* | 5/2012 | Naughton | B05C 17/00576 222/137 |
| 2012/0118917 | A1* | 5/2012 | Naughton | G01F 11/029 222/333 |
| 2012/0318826 | A1* | 12/2012 | Naughton | B05C 17/00596 222/327 |
| 2017/0157638 | A1* | 6/2017 | Beebe | B05C 17/014 |
| 2017/0189930 | A1* | 7/2017 | Turner | B05C 17/00553 |
| 2020/0316639 | A1* | 10/2020 | Ren | B05B 15/652 |

* cited by examiner

DRIP-FREE ELECTRIC MATERIAL DISPENSING DEVICE

RELATED APPLICATION

The present application claims the benefit of U.S. Provisional Application No. 62/908,670, filed Oct. 1, 2019, which is incorporated herein in its entirety by reference.

TECHNICAL FIELD

The present invention relates to hand-held power tools, more particularly to a handheld powered dispensing tool for dispensing caulk, glue, adhesives, lubricants or other materials to be dispensed from a tube, and more particularly, to a drip-free electric material dispensing device.

BACKGROUND

Handheld dispensing tools, such as those used to dispense caulk, adhesives, lubrications, and other viscous formulations, are typically manually operated by squeezing or grasping a handle of the dispensing tool. Typically a cylindrical shaped cartridge containing the caulk or other viscous material to be dispensed is loaded into the handheld dispensing tool, the cartridge having a piston at its back end and a nozzle at its front end. The handhold dispensing tool, generally referred to as a dispensing device, typically includes a partially open cartridge housing that enables the user to rapidly load the material cartridge into the device. To accommodate the nozzle at the front end of the cartridge, the cartridge housing will typically have a cartridge housing end plate that contains a bayonet slot opening that accommodates the cartridge nozzle. To enable the loading of the cartridge in this manner described, there must be some amount of axial movement available to the cartridge, for it to move along the cylindrical axis of the cartridge from front to back. This freedom of cartridge movement, or mechanical play, will exist until the dispensing device plunger mates with the piston in the cartridge, forcing the cartridge forward toward the cartridge housing end plate having the bayonet slot opening.

The actuating handle on the dispensing device is typically connected to a rack or rod that performs an advancing mechanism to incrementally advance a plunger against the piston inside of the cartridge, thereby forcing the material out the nozzle for it to be dispensed onto the work project. An undesirable effect that typically occurs with handheld dispensing tools is that the dispensed material continues to flow after the user stops applying pressure on the handle, leading to excessive material being dispensed on to the work project. This effect is frequently referred to as material "drip." Over the years there have been various attempts to minimize or prevent the drip that occurs from a handheld dispensing tool. For example, Rumrill, U.S. Pat. No. 7,073,691, is directed at a thumb activatable cam lever that engages or disengages a mechanism so that a dripless condition or a standard operation condition can be selected on the device. Several handheld dispensing tool improvements have also been directed at eliminating the need for a user to manually pump a handle to cause the material to be forced from the tool, with pneumatic and electrical motors being among the most popular designs.

The electric dispensing device has become fairly popular in recent years, whereby the use of rechargeable batteries and a small electric drive motor enable the tool to be completely portable by not requiring the attachment of hoses or wires. For example, Kishi, U.S. Pat. No. 4,615,469, is directed at a power operated dispensing device for dispensing a viscous substance using a battery pack to provide the power to the electrical motor contained within the device. Powered dispensing devices may be subject to the same undesirable effect of drip, whereby the material continues to flow for a period of time after the prime mover stops pushing the piston in the material-containing cartridge.

In an effort to minimize drip in electrical dispensing devices, product designers have developed motor control systems that briefly reverse the electric motor when the trigger control on the electric dispensing device is released. This action results in the plunger at the end of the push rod being pulled away from the piston inside the cartridge that contains the material being dispensed. For example, Naughton, U.S. Pat. No. 8,528,785, is directed at an auto-reverse circuit that momentarily drives the motor in a reverse direction when the user releases the trigger.

Despite the many improvements that have been made to handheld dispensing devices over the years, the problem of product drip occurring after the user releases the trigger continues to exist to some degree. The primary factor contributing to this problem is the design of the disposable cartridge that contains the viscous material being dispensed. The cartridge is hollow, typically being constructed of either plastic or cardboard. During operation, the sidewall of the cartridge deforms and elastically expands slightly in response to the fluid pressure of the material contained within the cartridge when the dispensing device plunger applies pressure to the piston in the cartridge. After the force on the piston is relaxed, the sidewall of the cartridge elastically relaxes, thereby causing material to continue flowing from the cartridge nozzle. Even in the case of an electric dispensing device design whereby the motor auto-reverses and pulls the plunger away from the cartridge piston when the trigger is released, some amount of drip may still occur. This drip may occur because of the friction that exists between the cartridge piston and the interior sidewall of the cartridge, whereby the residual fluid pressure within the cartridge is not released entirely by pushing the piston back toward the plunger. Instead, some amount of material may still flow from the nozzle, resulting in drip. Therefore, an ongoing challenge for electric material dispensing device manufacturers is to provide a system that entirely relieves the internal pressure on the material cartridge when the user releases the trigger, thereby resulting in a truly drip-free design.

SUMMARY

The challenges outlined above are addressed and overcome by the present invention. The present invention is directed at a drip-free electric material dispensing device that meets the requirement of positively stopping material flow from the nozzle of the cartridge when the trigger is released, thereby providing a truly drip-free material dispensing device. The drip-free electric material dispensing device of the present invention satisfies this criteria by utilizing a combination of several design features.

The present invention is comprised of a quick-action cartridge locking mechanism that positively locks the material cartridge in the cartridge housing. When the user loads the material cartridge into the cartridge housing, the cartridge housing lock mechanism is quickly pivoted into place, meeting the cartridge at its front end near the nozzle, firmly holding the cartridge in place. This action eliminates or minimizes the axial play in the cartridge, a feature that may work in conjunction with other design features to provide a drip-free material dispensing device in certain aspects of the present invention.

In some aspects of the present invention, the plunger assembly on the drip-free electric material dispensing device contains a plurality of radially-movable tangs. These tangs have sharp points that extend outward radially from the center axis of the plunger assembly. These pointed tangs, or dogs, operably engage the inside surface of the material cartridge's piston by at least partially penetrating the inside surface of the cartridge piston during the plunger assembly mating operation which occurs when the plunger assembly is first driven into the material cartridge piston after a cartridge is installed in the drip-free electric material dispensing device. The sharp points of the tangs, or dogs, axially lock the plunger assembly to the cartridge piston. In some aspects of the present invention, the axially locking of the plunger assembly to the cartridge piston works in conjunction with other design features to provide a drip-free material dispensing device.

In certain aspects of the present invention, the drip-free electric material dispending device is comprised of a specialized motor control circuit that automatically drives the motor in the reverse direction at a high speed for a predetermined length of time when the user releases the trigger. This action rapidly drives the plunger assembly in the reverse direction at a high speed for a predetermined length of travel when the user releases the trigger. Because the plunger assembly is positively mated to the cartridge piston by means of the radially-movable dogs that have gripped the inside surface of the piston, the action of reversing the plunger assembly pulls the cartridge piston in the reverse direction, overcoming any friction between the cartridge piston and the inside cartridge sidewall. This process quickly relieves any residual fluid pressure within the material cartridge, allowing the tension on the cartridge sidewalls to relax, and withdrawing an amount of the material from the cartridge nozzle exit. The predetermined distance of reverse travel of the plunger assembly will vary according to certain aspects, but in some aspects a reverse distance is approximately ⅛ inch to about 2 inches, in some other aspects about ¼ inch to about 1 inch, in some other aspects about ¼ inch to about ¾ inch, in some other aspects about ⅜ inch to about ½ inch, with ranges and subranges within the foregoing contemplated. Because of the effect of the quick-action cartridge locking mechanism that positively locks the material cartridge in the cartridge housing, as described above, axial movement of the cartridge has been restricted or eliminated. Therefore, the cartridge remains locked in position, preventing or restricting it from moving backwards when the cartridge piston is pulled backwards in response to the specialized motor control circuit that automatically drives the motor in the reverse direction when the user releases the trigger. This maximizes the benefit of the cartridge piston being pulled backward, thereby contributing to the drip-free design. In some aspects, the motor driven in the reverse direction is at least twice as fast as the forward direction, in some aspects about three times as fast as the forward direction, in some aspects about four times as fast as the forward direction. In some aspects, the forward direction is between about 2000 RPM and 10,000 RPM, in some other aspects between about 2500 RPM and about 8000 RPM. In some aspects, the reverse direction is about 10,000 RPM to about 25,000 RPM, in some aspects about 15,000 RPM to about 22,500 RPM, and in some other aspects about 17,500 RPM to about 20,000 RPM.

In some other aspects of the present invention, the gear drive assembly on the drip-free electric material dispensing device contains a quick-action gear release mechanism. When engaged by the user via a lever on the gear release mechanism, the plunger assembly is released from the gear transmission assembly, which allows the user to quickly move the plunger assembly axially in either direction forward or backward. This action allows for the rapid loading and unloading of a material cartridge from the drip-free electric material dispensing device, allowing the user to rapidly withdraw the plunger assembly from a material cartridge. For example, this feature is particularly helpful when a user partially expends a material cartridge, unloads it, and saves it for future use; and then when this partially-expended material cartridge is subsequently reloaded for later use. The quick-action gear release mechanism may also be used for other purposes.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
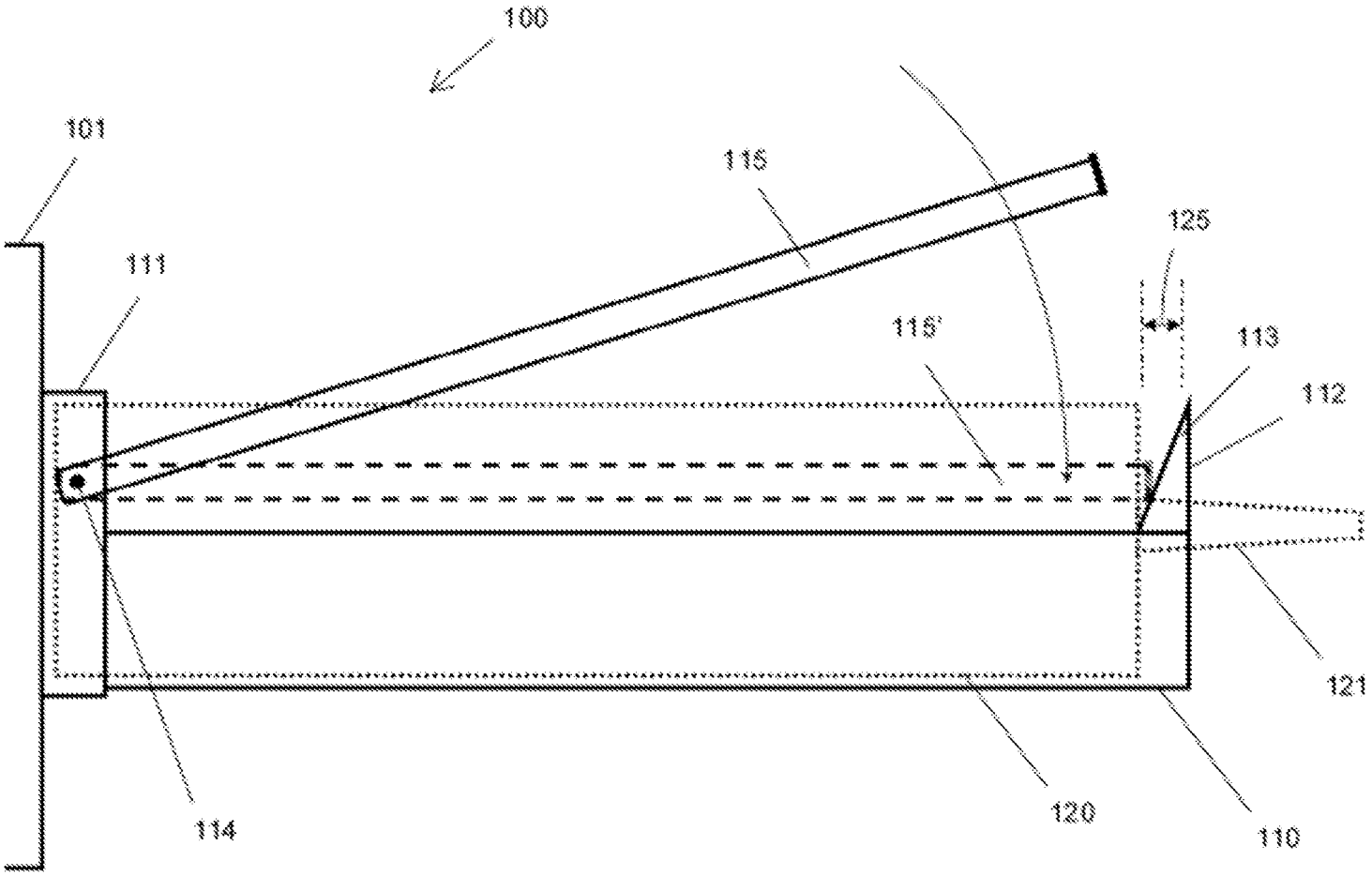
FIG. 1 is a right side plan view of the cartridge housing and cartridge locking mechanism of the drip-free electric material dispensing device according to certain aspects of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The preferred embodiment of the drip-free electric material dispensing device is as a hand-help portable electrically powered material dispensing device that is designed to accommodate a dispensing material cartridge, such as caulk, lubricant, glue, or adhesive cartridge, of the size that is generally available within the industry. The various aspects and embodiments shown herein illustrate the drip-free electric material dispensing device designed to accommodate the standard size cartridge of caulk, sealant, or adhesive, generally having a capacity of approximately 10-11 U.S. ounces, because this is generally the popular size that is used in handheld dispensers. Alternative embodiments may include a drip-free electric material dispensing device designed to accommodate the larger U.S. quart size cartridge, which is popular on construction sites, and the twin-tube caulk cartridge that may contain a two-part epoxy or other formulation. Moreover, alternative embodiments of the drip-free electric material dispensing device may include a design that contains a corded power supply, or a non-portable design that may be used in an industrial manufacturing operation such as on an assembly line.

Referring now to FIG. 1, the drip-free electric material dispensing device 100 may have a cartridge locking mechanism 115. Cartridge housing 110 extends forward from cartridge housing base 111, with cartridge housing end plate 112 being at the forward end of cartridge housing 110.

Cartridge housing base 111 is mounted on the gearbox assembly 101 of drip-free electric material dispensing device 100. Material cartridge 120 is loaded into cartridge housing 110, with the back end of material cartridge 120 being seated into cartridge housing base 111. Cartridge housing end plate 112 has a slot opening 113 which accommodates material cartridge nozzle 121 at the forward end of material cartridge 120. After material cartridge 120 is inserted into cartridge housing 110, the user pulls it back toward the direction of cartridge housing base 111. At this point, gap 125 exists between material cartridge 120 and cartridge housing end plate 112. At this point the user lowers cartridge locking mechanism 115 toward material cartridge nozzle 121, allowing it to rotate downward with cartridge locking mechanism pin 114 forming the axis of downward rotation. Cartridge lock mechanism 115' makes contact with material cartridge 120, locking it into place and thereby limiting motion of material cartridge 120 in the forward direction.

Figure 2A:
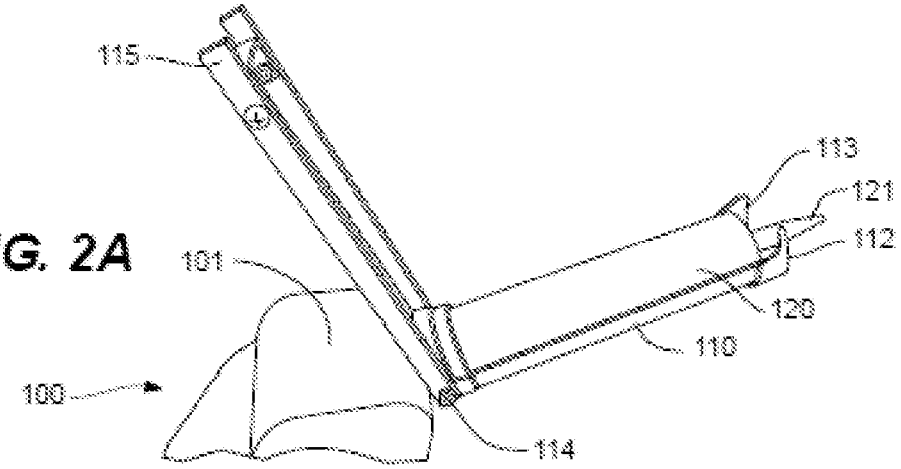
FIG. 2A is a top right perspective view of the cartridge housing of the drip-free electric material dispensing device according to certain aspects of the present invention, showing the cartridge locking mechanism in the open position.

Referring now to FIG. 2A, a top right perspective view showing an embodiment of the drip-free electric material dispensing device 100 with cartridge locking mechanism 115 in the fully open position. This is the position that would enable the loading of material cartridge 120 into cartridge housing 110, with the figure illustrating a material cartridge resting in cartridge housing 110. Material cartridge nozzle 121 protrudes forward from cartridge housing 110 via cartridge housing end plate slot 113 that exists in cartridge housing end plate 112.

Figure 2B:
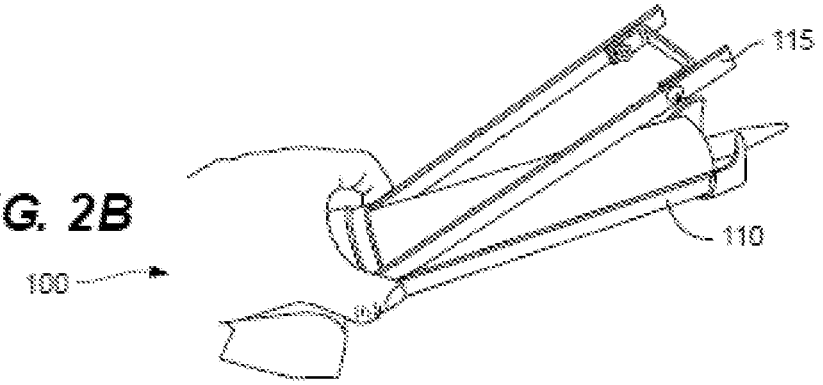
FIG. 2B is a top right perspective view of the cartridge housing of the drip-free electric material dispensing device of FIG. 2A, showing the cartridge locking mechanism in the partially closed position.

FIG. 2B shows an embodiment of the drip-free electric material dispensing device 100 with cartridge locking mechanism 115 in the partially closed position, which is similar to the position shown earlier in FIG. 1. As noted above, the user lowers cartridge locking mechanism 115 toward material cartridge nozzle 121, allowing it to rotate downward with cartridge locking mechanism pin 114 forming the axis of downward rotation.

Figure 2C:
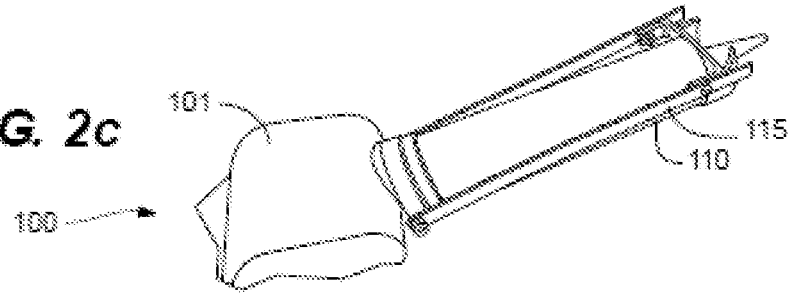
FIG. 2C is a top right perspective view of the cartridge housing of the drip-free electric dispensing device of FIGS. 2A-2B, showing the cartridge locking mechanism in the locked position.

FIG. 2C shows an embodiment of the drip-free electric material dispensing device 100 with cartridge locking mechanism 115 in the fully closed position, making contact with material cartridge 120 near the point where material cartridge nozzle 121 is attached to material cartridge 120. As noted earlier in FIG. 1, cartridge locking mechanism 115 locks material cartridge 120 in place, thereby limiting or restricting motion of material cartridge 120 in the forward direction.

Referring now generally to FIGS. 15A-16D, an alternative embodiment of a cartridge locking device for the drip-free electric material dispensing device 100 is illustrated. In the embodiment illustrated, a snare 165 applies downward force to the upper region of material cartridge 120, driving it downward into grip point 171. Snare 165 may be flexible, being manufactured from wire rope or similar material, or it may be pre-formed. In the embodiment illustrated in FIGS. 15A and 15B, when latch clasp 167 is in the open position, snare 165 operably engages with latch hook 166. When latch clasp 167 is moved into the closed position, tension is applied to snare 165, thereby pushing downward on material cartridge 120. Latch hook 166 and latch clasp 167 may be attached to opposite sides of cartridge housing end plate 112 by a variety of means which are available in the mechanical arts, such as rivets, threaded fasteners, welding, or brazing. Alternatively, latch hook 166 and latch clasp 167 may be formed from the same material as cartridge housing end plate 112, being integral to cartridge housing end plate 112. Snare 165 may be connected to latch clasp 167 by a variety of means which are available in the mechanical arts. In an embodiment, the length of snare 165 may be adjustable. In an alternative embodiment, snare 165 may be detachable from latch clasp 167 and snares 165 of varying sizes be made available, with the appropriately sized snare 165 being selected to accommodate the size of material cartridge 120 being used.

Figure 16A:
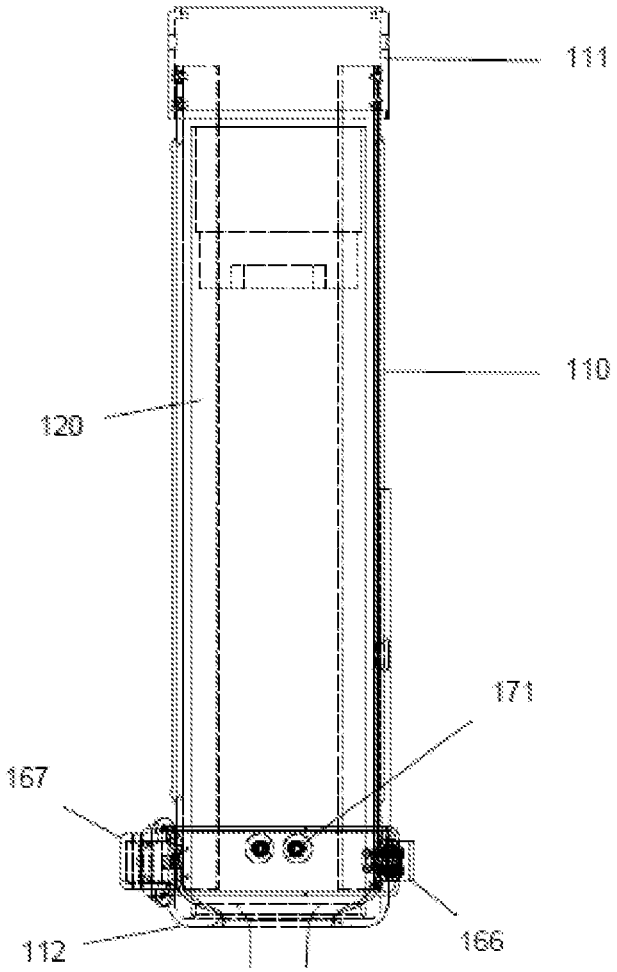
FIG. 16A is a top plan view of the alternative embodiment of the cartridge locking mechanism in FI. 15A.
Figure 16B:
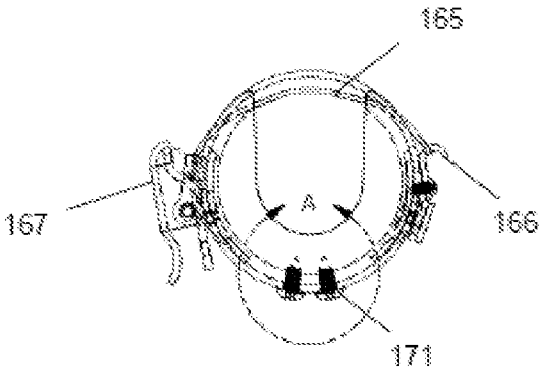
FIG. 16B is a front plan view of the alternative embodiment of the cartridge locking mechanism in FIG. 15A.
Figure 16C:
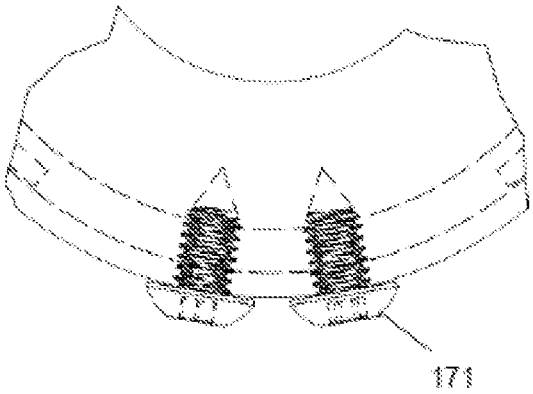
FIG. 16C is a detailed front plan sectional view of the cartridge locking mechanism in FIG. 15A.
Figure 16D:
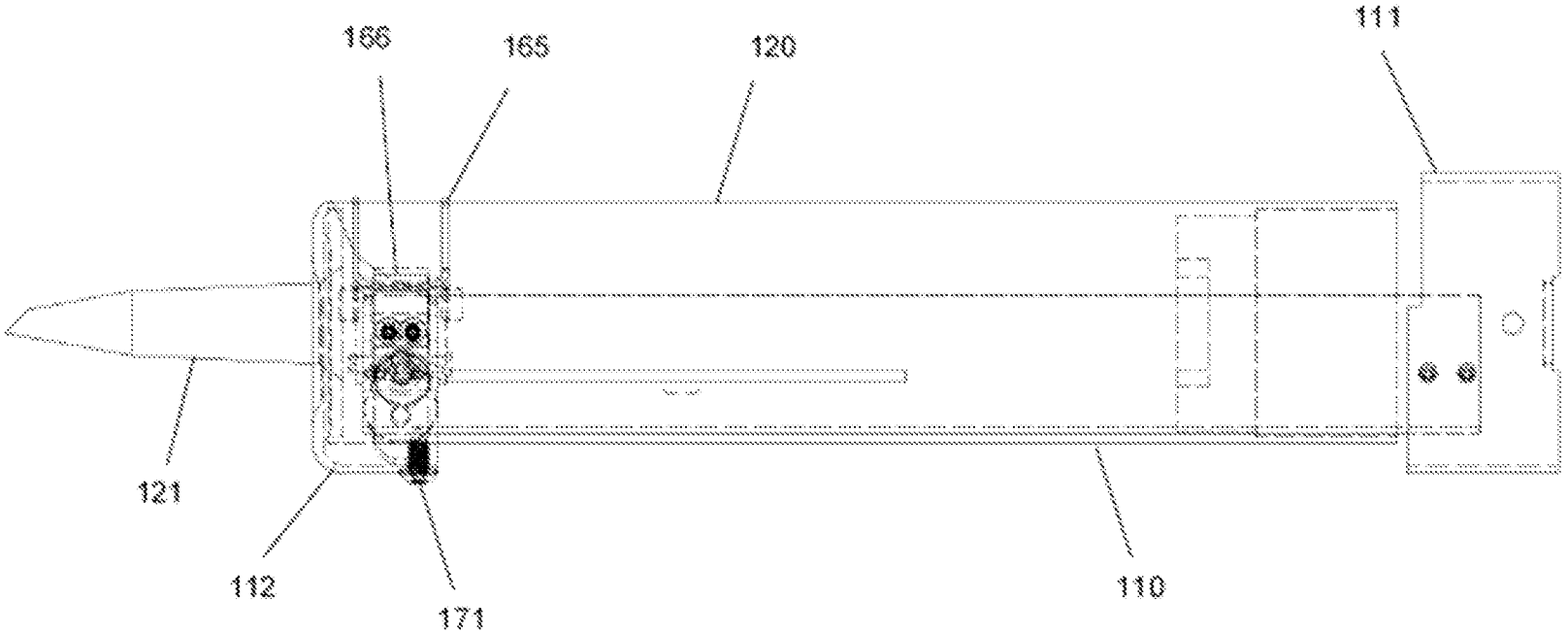
FIG. 16D is a side plan view of the alternative embodiment of the cartridge locking mechanism in FIG. 15A.

As illustrated in FIGS. 16A through 16C, a plurality of grip points 171 exist which may operably engage with the outer surface of material cartridge 120 when material cartridge 120 is driven downward by snare 165 as described above. Grip points 171 have a sharp point that projects upward to grip the outer surface of material cartridge 120. In the embodiment illustrated, two grip points 171 are used, however any number of grip points may be used. In the embodiment illustrated, grip points 171 are screw points, however in other embodiments any suitable means may be used for creating grip points on the inner surface of cartridge housing 110. In an embodiment, grip points 171 may be deployed at any position along the interior surface of cartridge housing 110. In other embodiments, there may be no grip points deployed on cartridge housing 110, and other means may be used to cause cartridge housing 110 to operably engage material cartridge 120 when material cartridge 120 is so inserted in cartridge housing 110. For example, an equivalent design for a cartridge latching mechanism may be utilized to limit the axial movement of material cartridge 120 along cartridge housing 110. In an embodiment, a griping liner may be utilized on the interior surface of cartridge housing 110 to operable engage material cartridge 120. In another embodiment, an adhesive may be utilized on the interior surface of cartridge housing 110 to operable engage material cartridge 120.

Figure 3A:
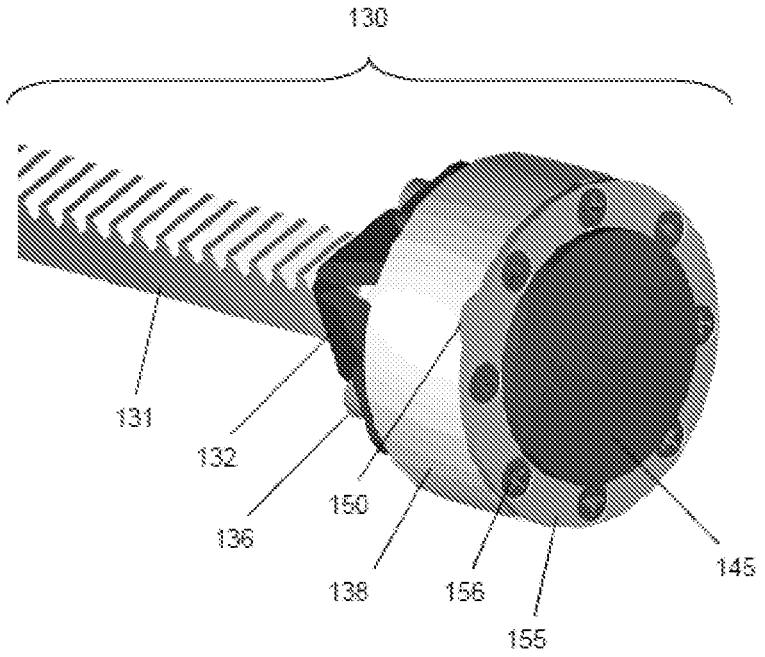
FIG. 3A is a front side perspective view of the plunger assembly of the drip-free electric material dispensing device according to certain aspects of the present invention, with the tangs of the plunger assembly in the retracted position.

Referring now to FIG. 3A, a plunger assembly 130 of the drip-free electric material dispensing device is illustrated. Plunger assembly 130 is driven forward and back via rack 131. In this embodiment, rack 131 is driven forward and back by the rack gear drive transmission assembly of the drip-free electric material dispensing device 100. Rack 131 is attached to bracket 132, with bracket 132 being attached to plunger housing 138 via a plurality of plunger bolts 136. The forward-facing circumferential surface of plunger housing 138 contains plunger retainer 155, which is mounted to plunger 138 by a plurality of plunger retainer screws 156.

A plurality of tabs or dogs 150 extend radially from the plunger housing 138 near its forward-facing circumference immediately behind plunger retainer 155. Protruding from plunger 130 in the forward direction is the forward surface of cone 145.

Figure 3B:
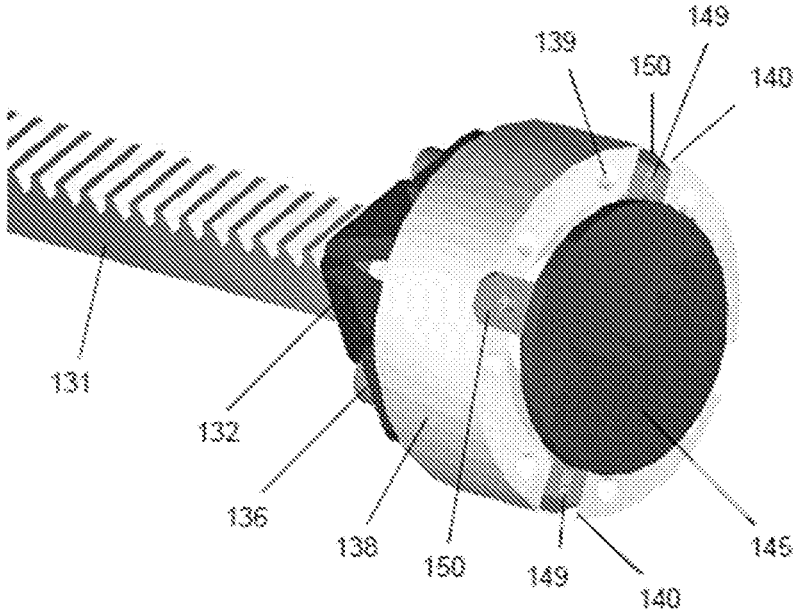
FIG. 3B is a front side perspective view of the plunger assembly of the drip-free electric material dispensing device of FIG. 3A, the plunger assembly shown in a partially disassembled state to illustrate the tangs in the retracted position.

FIG. 3B shows an embodiment of the plunger assembly 130 of the drip-free electric material dispensing device in a partial state of disassembly, wherein plunger retainer 155 and plunger retainer screws 156 have been removed to reveal the arrangement of tabs or dogs 150 which extend radially from plunger assembly 130. Dogs 150 point radially outward from plunger assembly 130, being aligned in plunger dog canyon 140, with the radial motion of dog 150 being constrained by dog alignment post 149. In the embodiment illustrated, four dogs 150 are situated around the circumference of plunger housing 138, with approximately 90 degrees of angular arc between the centerlines of each dog 150. Because of the perspective view of FIG. 3B, three dogs 150 are clearly visible. In other embodiments, a greater or lesser number of dogs 150 may be utilized and their circumferential spacing may be symmetrical or nonsymmetrical. For instance, in some aspects the plunger assembly 130 may contain at least two dogs 150, in some aspects at least three dogs 150, in some other aspects at least four dogs 150, in some other aspects at least three to about 10 dogs, in some other aspects up to at least 10 dogs 150.

Figure 4A:
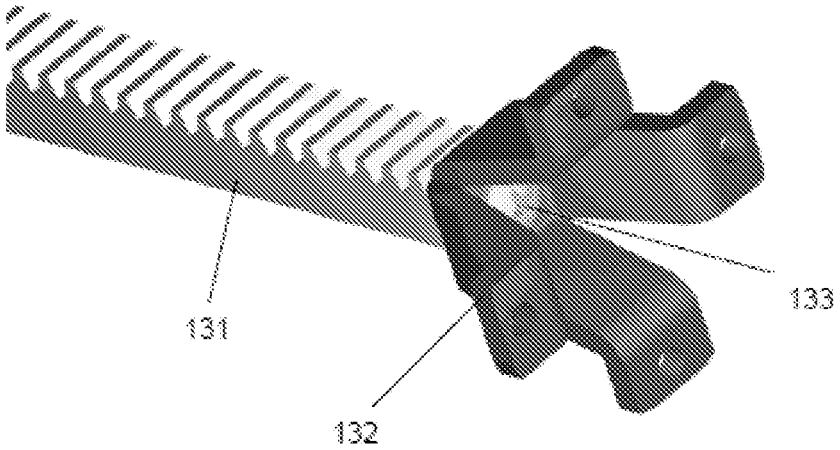
FIG. 4A is a front side perspective view of partially assembled components of the plunger assembly of the drip-free electric material dispensing device according to certain aspects of the present invention.

Referring now to FIG. 4A, a front side perspective view showing only a few components of plunger assembly 130 of an embodiment of the drip-free electric material dispensing device. In the illustrated embodiment, rack 131 is attached to bracket 132 by bracket mounting screw 133. In other embodiments different means of attachment may be used. In an alternative embodiment, rack 131 and bracket 132 may be molded or machined from a single mechanical component.

Figure 4B:
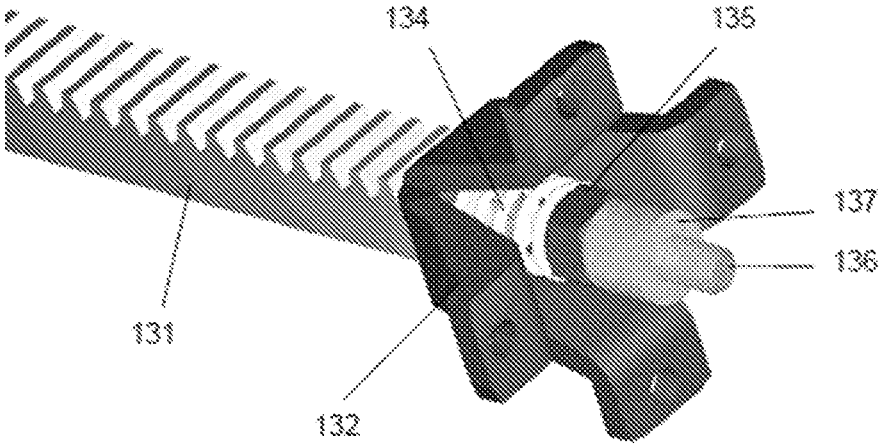
FIG. 4B is a front side perspective view of partially assembled components of the plunger assembly of the drip-free electric material dispensing device according to certain aspects of the present invention.

FIG. 4B is a front side perspective view showing a few additional components of plunger assembly 130 of an embodiment of the drip-free electric dispensing device. Plunger spring is inserted in the interior of bracket 132, with its compression axis in alignment with the direction of motion of plunger assembly 130 during operation. Plunger nut 135 is threadably attached to plunger bolt 136, and plunger bolt spacer 137 surrounds a portion of the threaded portion of plunger bolt 136. In an embodiment, plunger nut 135 and plunger bolt 136 may be combined in a single piece. In another embodiment, plunger spacer 137 may also be combined with the aforementioned components into a single piece.

Figure 5:
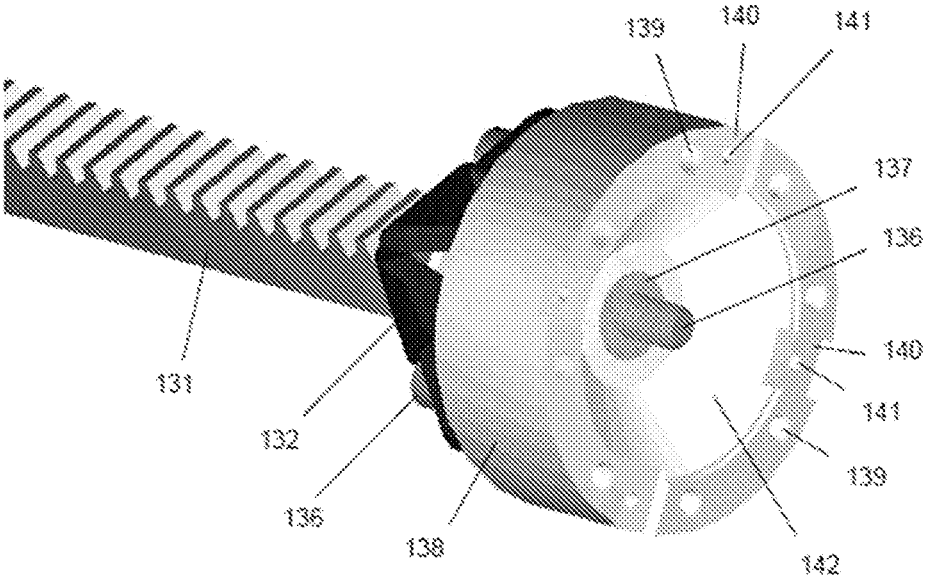
FIG. 5 is a front side perspective view of partially assembled components of the plunger assembly of the drip-free electric material dispensing device according to certain aspects of the present invention.

Referring now to FIG. 5, a front side perspective view of a partially assembled embodiment of the plunger assembly of the drip-free electric material dispensing device. Plunger housing 138 is attached to bracket 132 by a plurality of plunger bolts 136. In an embodiment, a different means of attachment may be utilized. A plurality of threaded cavities 139 surround the forward-facing periphery of plunger housing 138. A plurality of axial-facing plunger dog canyons 140 surround the forward-facing periphery of plunger housing 138. In the embodiment illustrated, four plunger dog canyons 140 are utilized, each being spaced approximately 90 degrees around the periphery of plunger housing 138. In various embodiments, a different number of plunger dog canyons 140 may be used, with either uniform or nonuniform spacing. Each plunger dog canyon 140 has a plunger dog canyon cavity 141, with these features being designed to support and position dogs 150 as will be later described. The interior of plunger housing 138 has a generally radially uniform shape with interior slope 142.

Figures 6A, 6B:
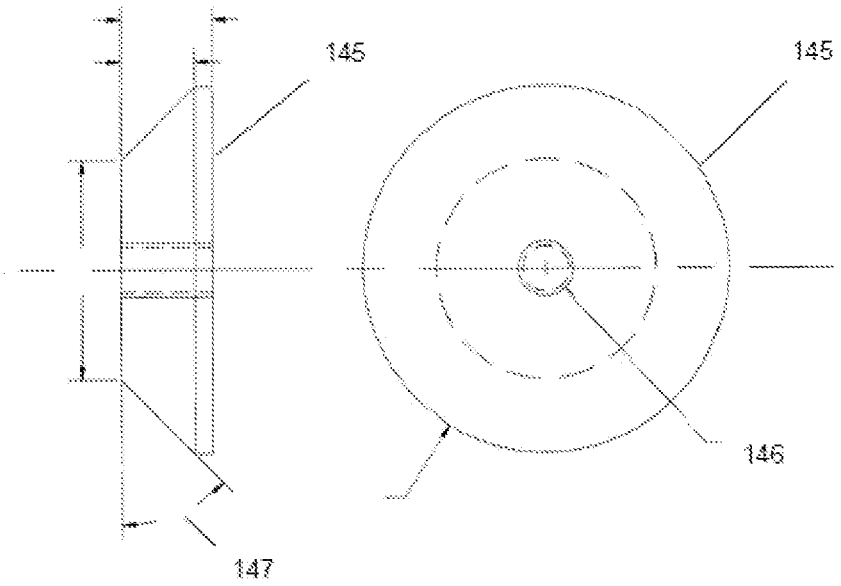
FIG. 6A is a side plan view of the cone component of the plunger assembly of the drip-free electric material dispensing device according to certain aspects of the present invention.
FIG. 6B is an end plan view of the cone component of the plunger assembly of the drip-free electric material dispensing device of FIG. 6A.

Referring now to FIG. 6A, a side plan view of an embodiment of the cone of the plunger assembly of the drip-free electric material dispensing device. Cone 145 generally has a truncated conical shape, with cone angle 147 describing the slope of cone 145. In an embodiment, cone angle 147 will generally be selected to mate with the angle defined by interior slope 142 of plunger housing 138, however it is not necessary they be equivalent. In an embodiment, the angular measure of cone angle 147 may be about 45 degrees, while in other aspects the cone angle 147 may be about 25 degrees to about 90 degrees. In other embodiments, cone angle 147 may range between 10 and 80 degrees. In alternative embodiments, cone angle 147 may be any angular value so long as the circumferential surface of cone 145 makes operable contact with dogs 150 as will be later described. Cone threaded cavity 146 is located in the back side of cone 145 near its center, with the machine threads of cone threaded cavity 146 being selected to threadably mate with plunger bolt 136. In alternative embodiments, the mating of plunger bolt 136, or its equivalent, to cone 145 may be by a different means sufficient to serve the purpose described herein.

FIG. 6B is a front plan view of an embodiment of the cone of the plunger assembly of the drip-free electric material dispensing device. The forward face of cone 145 in this view was the forward-facing aspect presented in FIGS. 3A and 3B. In some aspects, the forward face of cone 145 may be circular, while in other aspects other geometric shapes may be applicable, such as octagons or other polygon shaped faces.

Figures 7A, 7B:
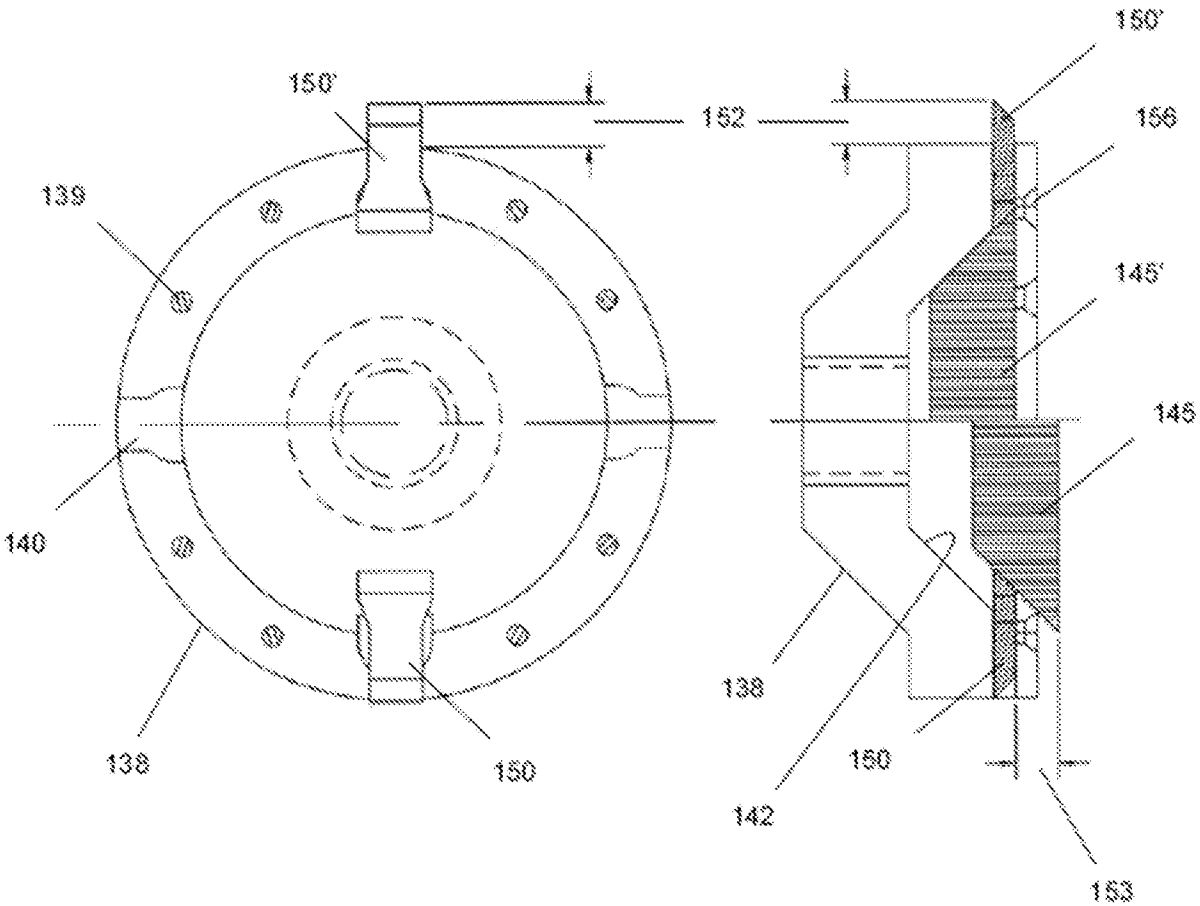
FIG. 7A is an end plan view illustrating the tangs or dogs and housing of the plunger assembly of the drip-free electric material dispensing device according to certain aspects of the present invention.
FIG. 7B is a split side plan view illustrating the tangs or dogs, cone, and housing of the plunger assembly in two modes of operation of the drip-free electric material dispensing device according to certain aspects of the present invention.

Referring now to FIG. 7A, an end plan view illustrating the dogs and housing of the plunger assembly, and FIG. 7B, a split side plan view illustrating the dogs, cone, and housing of the plunger assembly in two modes of operation, of the drip-free electric material dispensing device according to an embodiment of the present invention. Plunger spring 134, as seen in FIG. 4B, exerts a force on cone 145 in the forward direction, creating a gap between cone 145 and the interior of plunger housing 138 as seen in the lower halves of FIGS. 7A and 7B. Plunger spring 134 is sized to exert a bias force in the forward direction of cone 145, with the force being of a magnitude suitable to effect the operation of plunger assembly 130 described herein. In the free state, dog 150 is recessed in plunger dog canyon 140, not extending outward past the outer circumference of plunger housing 138. When cone 145 is pushed back by an axial force in rearward direction, it moves into the interior void that existed between cone 145 and plunger housing 138. As cone 145 continues rearward, the angled face of cone 145 makes contact with plunger housing interior slope 142, thereby forcing dogs 150 radially outward from plunger housing 138. In the embodiment illustrated, the angle of plunger housing interior slope 142 is similar to cone angle 147, where cone angle 147 was described in FIG. 6A. In other embodiments the angle of plunger housing interior slope 142 may be significantly different from cone angle 147, so long as cone 145 operably engages with dogs 150 to force them radially outward as described herein. The action of pushing cone 145 rearward relative to plunger housing 138 has the effect of compressing plunger spring 134. Cone 145 travels in the rearward axial direction relative to plunger housing 138, with new position being denoted as cone 145'. By this action, dogs 150 will travel radially outward distance 152, thereby protruding from the outer circumference of plunger housing 138, with their new position being denoted as dogs 150'.

Figure 8A:
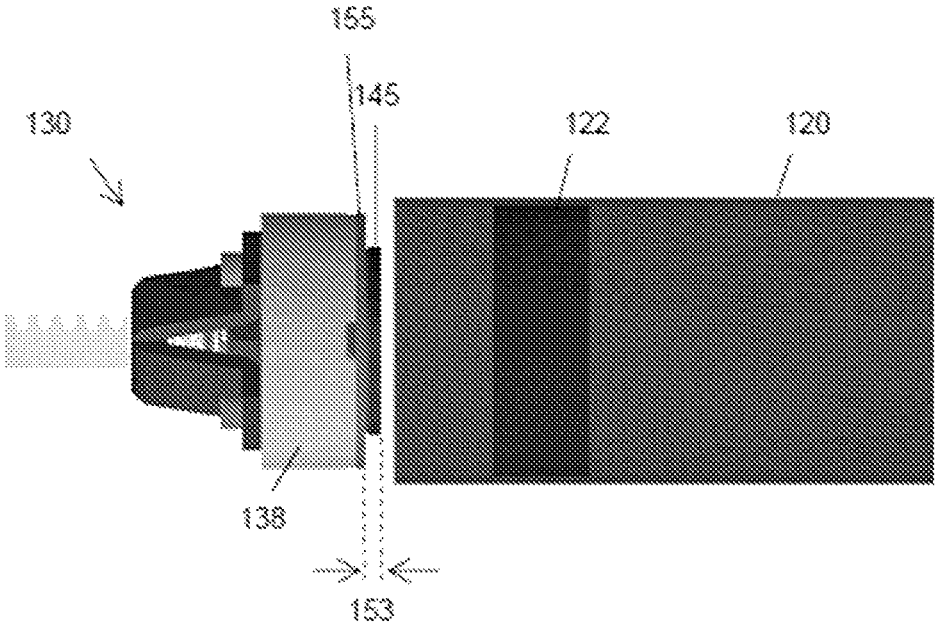
FIG. 8A is a side plan view of the plunger assembly of the drip-free electric material dispensing device according to certain aspects of the present invention, shown in alignment with a material cartridge containing material to be dispensed and prior to making contact with the material cartridge.

Referring now to FIG. 8A, a side plan view of the plunger assembly of the drip-free electric material dispensing device according to an embodiment of the present invention. As shown, plunger assembly 130 is in alignment with material cartridge 120, but contact has not been made. In an embodiment, material cartridge 120 would be locked in cartridge cradle or housing 110 by cartridge lock mechanism 115 as illustrated in FIGS. 1 and 2C. As shown, cone 145 protrudes from plunger assembly 130 by the bias force caused by plunger spring 134. The axial displacement between the forward face of cone 145 and retainer ring 155 is approximately distance 153, as described in FIGS. 7A and 7B. In an embodiment, distance 153 may range between 1/64 inch and ½ inch. In other embodiments, it may be a greater or lesser distance so long as it achieves the purpose of protruding in the forward direction from the forward surface of retainer 155 a distance that will allow cone 145 to operably engage dogs 150 as will later be described.

Figure 8B:
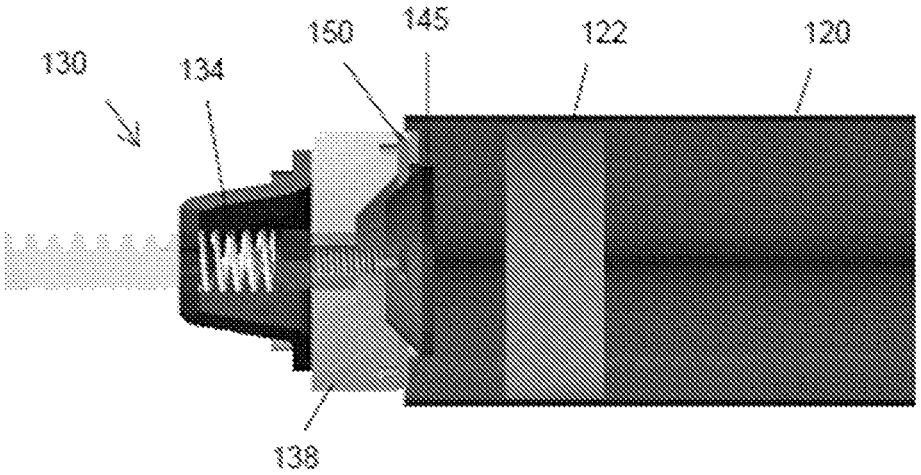
FIG. 8B is a side plan view of the plunger assembly of the drip-free electric material dispensing device of FIG. 8A, shown at the point of entering the inside area of the material cartridge.

FIG. 8B is a side plan view of the plunger assembly of the drip-free electric material dispensing device according to an embodiment of the present invention. FIG. 8B is similar to FIG. 8A, but plunger assembly 130 has advanced forward in cartridge housing 110 to the point of just entering material cartridge 120 from the back of material cartridge 120. Various embodiments of the present invention will accommodate a variety of sizes of material cartridges 120. Those who are skilled in the art will appreciate that standardized sizes of material cartridges are commercially available, thereby resulting in standardized sizes for cartridge housing 110 being used in the industry. Accordingly, the size of plunger housing 138 and its associated components will generally be selected to accommodate the particular size of material cartridge 120. In other embodiments, practically any size of plunger housing 138 may be used so long as it achieves the purpose of operably engaging the piston of material cartridge 120 as will later be described.

Figure 9A:
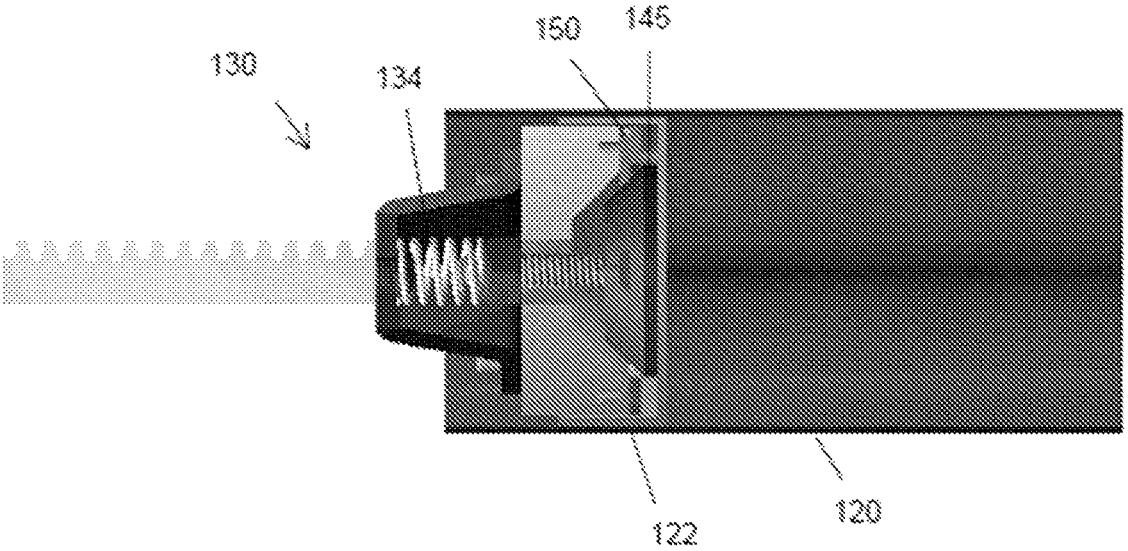
FIG. 9A is a side plan view of the plunger assembly of the drip-free electric material dispensing device according to certain aspects of the present invention, shown at the point of the plunger operably making contact with the piston of a material cartridge.

Referring now to FIG. 9A, a side plan view of the plunger assembly of the drip-free electric material dispensing device according to an embodiment of the present invention. FIG. 9A is similar to FIGS. 8A and 8B, but plunger assembly 130 has advanced forward in cartridge housing 110 to the point of just making contact with the rear surface of material cartridge piston 122. As shown, cone 145 extends forward from retainer ring 155 as a result of the forward axial bias from the axial force of plunger spring 134. As was described in FIG. 8A, the forward extension of cone 145 is distance 153. As was described in FIG. 8B, dogs 150 are in their normal retracted state inside of plunger housing 138.

Figure 9B:
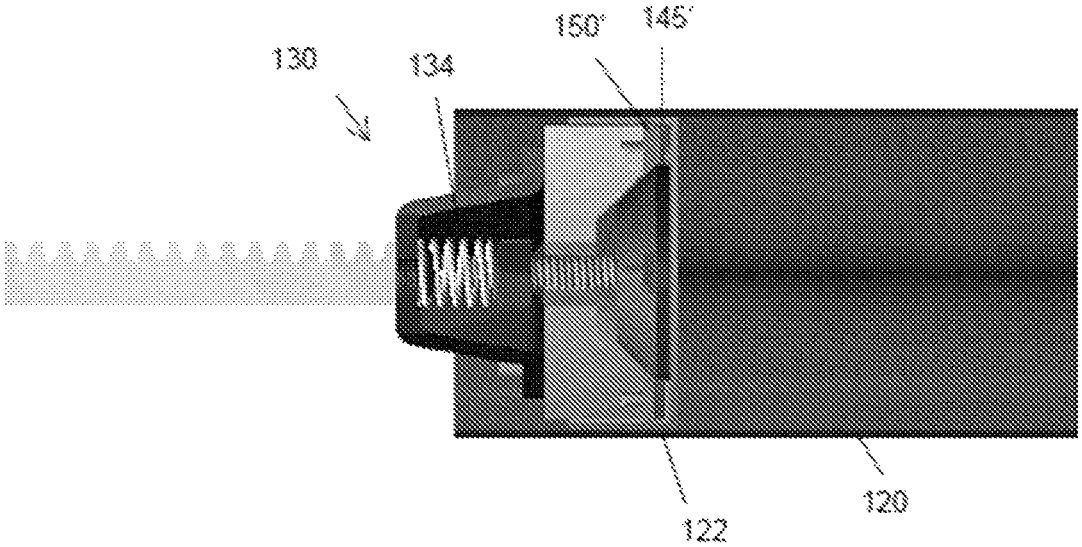
FIG. 9B is a side plan view of the plunger assembly of the drip-free electric material dispensing device of FIG. 9A, shown with the tangs or dogs extending from the plunger assembly and operably engaging with the piston of a material cartridge.

FIG. 9B is a side plan view of the plunger assembly of the drip-free electric material dispensing device according to an embodiment of the present invention, similar to FIGS. 8A, 8B, and 9A. However, in FIG. 9B, plunger assembly 130 has continued advancing forward in cartridge housing 110 to the point of making compressive contact with the rear surface of material cartridge piston 122. The forward motion of plunger assembly 130 drives plunger housing 138 forward relative to cone 145', thereby pushing cone 145' rearward into plunger housing 138. As cone 145' makes contact with interior slope 142, dogs 150' are forced radially outward, biting into the interior surface of material cartridge piston 122 and thereby biting into or locking plunger assembly 130 to material cartridge piston 122. In the embodiment illustrated, the forward surface of cone 145 is generally aligned with the forward planar surface of retainer 155, resulting in this distance of travel being approximately the distance 153 as was described in FIG. 8A. In other embodiments, this distance of travel may be greater or lesser than distance 153 depending on the particular design of plunger assembly 130, the interior surface contour of material cartridge piston 122, and other factors. As a result of the rearward travel of cone 145 relative to plunger housing 138, dogs 150 are forced to travel radially outward distance 152, thereby protruding from the outer circumference of plunger housing 138, with their new position being denoted as dogs 150'. In various embodiments, the distance of outward travel of dogs 150 will vary depending on the size of material cartridge 120 being accommodated by the drip-free electric material dispensing device 100, and the nature of the design of material cartridge 120 and its contents. In an embodiment, distance 152 may range between 1/64 inch and 1/4 inch. In other embodiments, it may be a greater or lesser distance so long as it achieves the purpose of operably engaging the piston of material cartridge 120 as will later be described. The feature in this embodiment whereby plunger assembly 130 operably engages with the material cartridge piston 122 contributes to the drip-free operation of drip-free electric material dispensing device 100. When the motor of drip-free electric material dispensing device 100 is changed to from operating in the forward direction to then operate in the reverse direction, the power train will move plunger assembly 130 in the rearward direction, withdrawing pressure and also the plunger assembly 130 from material cartridge 120. Because dogs 150' have operably engaged with the interior surface of material cartridge piston 122, the rearward motion of plunger assembly 130 will pull material cartridge piston 122 in the rearward direction. Because material cartridge 120 is firmly held in cartridge housing 110 by the operation of cartridge lock mechanism 115 which limits or restricts the axial motion of material cartridge 120, material cartridge piston 122 is forced to move rearward relative to material cartridge 120. In an embodiment, drip-free electric material dispensing device 100 will operate in the reverse direction automatically when the user releases the trigger that is used to energize the electric motor of drip-free electric material dispensing device 100, as a result of the control circuitry which will be described herein. This automatic reverse-direction action rapidly withdraws material cartridge piston 122 from the interior of material cartridge 120, rapidly releasing the interior fluid pressure of material cartridge 120. In a typical embodiment, the sidewalls of material cartridge 120 are flexible and materially elastic, often being constructed of plastic or cardboard. When a highly viscous product is being forcibly dispensed from material cartridge 120 via material cartridge nozzle 121, interior fluid pressure may cause expansion of the sidewalls of material cartridge 120. This interior pressure is relieved by the rapid withdrawal of material cartridge piston 122. In an embodiment, the rearward motion of material cartridge piston 122 may be great enough to create a slight negative pressure within material cartridge 120, thereby sucking the material being dispensed back into material cartridge nozzle 121. In an embodiment, the rearward motion of plunger assembly 130 may be great enough to partially or completely evacuate material from the interior of material cartridge nozzle 121. In another embodiment, the rearward motion of plunger assembly 130 may be set so it is simply halts the continued discharge of material from material cartridge nozzle 121. The rearward displacement of plunger assembly 130 needed to effectuate the afore described chain of events will vary, depending on various factors that may include the size of material cartridge 120, the type of material contained within material cartridge 120, the nature of the work being performed, and the skill level of the user operating drip-free electric material dispensing device 100. In a typical embodiment, the rearward motion of plunger assembly 130 may be approximately 3/8 inch. In other embodiments, it may range between about 1/8 inch and about 1 inch. In an embodiment it may be less than about 1/8 inch. In another embodiment, it may be possible to disable the reverse functionality. Finally, in another embodiment, the distance of rearward motion may be greater than 1 inch. Those who are skilled in the art will appreciate that in general, a larger material cartridge 120 may require a greater distance of motion in the reverse direction to achieve the desired effect. It is possible for the present invention to be scaled to an embodiment of practically any size.

In some aspects, the plunger assembly 130 can be fastened onto an existing power device. In some aspects, the plunger assembly 130 can be integral with the rack of a power device, with the plunger assembly/rack configuration applied to an existing power device or to a new device.

Figure 10:
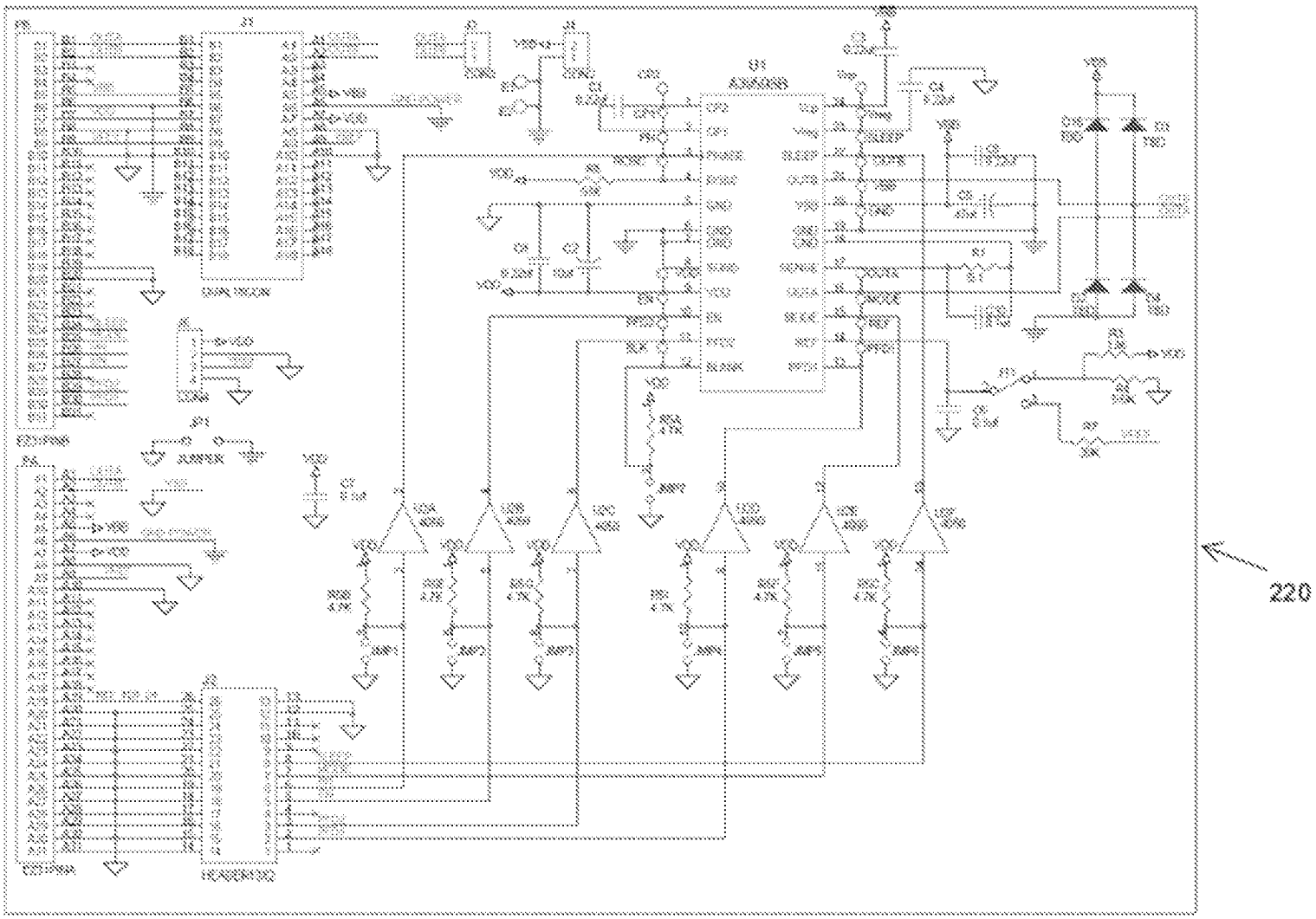
FIG. 10 is an electrical schematic diagram showing an embodiment of the motor auto-reversing circuitry of the drip-free electric material dispensing device according to certain aspects of the present invention.

Referring now to FIG. 10, an electrical schematic diagram showing an embodiment of the motor auto-reversing circuitry of the drip-free electric material dispensing device of the present invention. Motor control circuitry 220 senses the position of trigger 102 on drip-free electric material dispensing device 100. When the user applies force to trigger 102, motor control circuitry energizes motor 103 in the forward direction at a predetermined speed. In an embodiment, the forward speed of the motor will be selected to advance rack 131 in a forward direction at a rate which will yield the desired flow rate of material from material cartridge nozzle 121. Several factors will determine the desired forward speed of motor 103 including the gear ratio of gearbox assembly 101, the size of material cartridge 120, the size of material cartridge nozzle 121, the type of product being dispensed from drip-free electric material dispensing device 100, the nature of the work being performed by the user, and the experience level of the user. In an embodiment, one preset speed may be used. In another embodiment, the forward speed may be programmable by the user, either internally or externally on drip-free electric material dispensing device 100. In an alternative embodiment, the forward speed may be determined by how much force the user applies to trigger 102, or how far the user moves trigger 102. In the embodiment illustrated, when the user releases trigger 102, motor control circuitry 220 automatically reverses the direction of motor 103 by energizing motor 103 in the reverse direction. In an embodiment, the magnitude of the reverse speed may be much greater than that of the forward speed. In an embodiment, the reverse speed may be as great as possible given the power supply voltage, electrical current handling capability of motor control circuitry 220, and mechanical torque design limits of gearbox assembly 101 and rack 131. Those who are skilled in the art will appreciate that motor 103, typically being a small DC motor, is able to generate peak torque and operate at maximum efficiency while driven at a speed that may be on the order of several thousand revolutions per minute (rpm). Accordingly, as will be later described, an assembly of reduction gears and a mechanical transmission assembly are used to transfer the relatively high rotation speed of motor 103 into a relatively low linear speed of plunger assembly 130 in the axial direction. In a typical embodiment, a forward speed of motor 103 may be 6,500 rpm and a reverse speed of motor 103 may be 20,000 rpm. In other embodiments, the magnitude of speeds may be greater or lesser than this. Those who are skilled in the motor arts will appreciate that larger motors, such as those used on a larger design or in a non-portable industrial application, may generally operate at lower rotational speeds. As noted, the actual values of speed in either direction may vary greatly. Motor control circuitry 220 will energize motor 103 in the reverse direction for a predetermined length of time established to yield a predetermined reverse distance of travel of plunger assembly 130. Finally, motor control circuitry 220 de-energizes motor 103 after a period of time that is determined to yield the desired reverse direction of travel of plunger assembly 130. By the action of the dogs 150 which bite into the inside surface of material cartridge piston 122, as described in FIG. 9B, the material being dispensed from drip-free electric material dispensing device 100 will stop exiting from material cartridge nozzle 121, thereby producing a drip-free experience for the user of drip-free electric material dispensing device 100. As was previously noted, the material being dispensed from drip-free electric material dispensing device 100 may actually be sucked back in to material cartridge nozzle 121, depending on the embodiment. It is also possible that material may be partially or entirely evacuated from material cartridge nozzle 121, depending on the embodiment.

Figure 11:
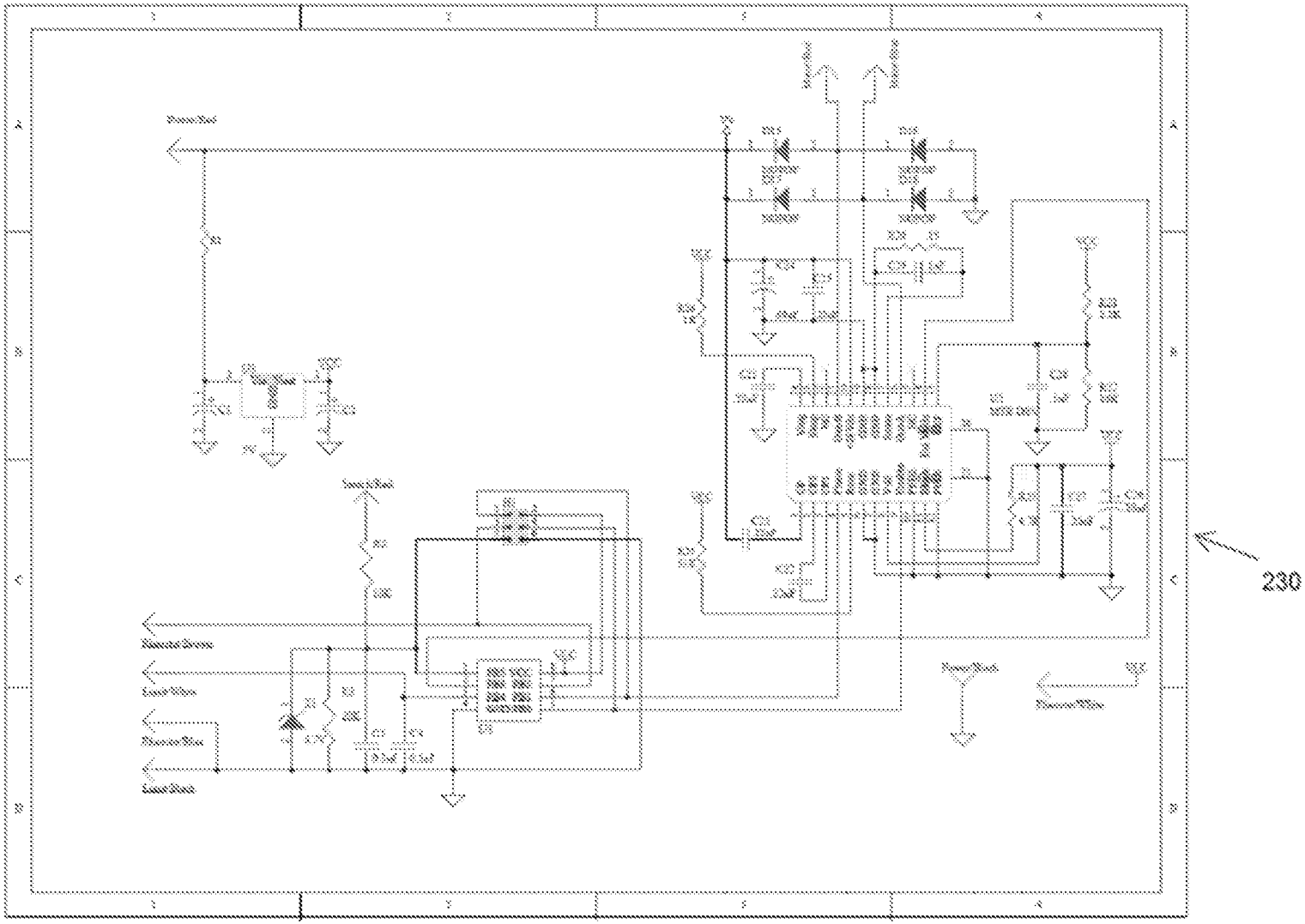
FIG. 11 is an electrical schematic diagram showing an alternative embodiment of the motor auto-reversing circuitry of the drip-free electric material dispensing device according to certain aspects of the present invention.

Those who are skilled in the art will appreciate that the type and size of motor 103 used in a particular embodiment may vary greatly, depending on the embodiment. Accordingly, different electrical circuits may be used to produce the auto-reverse functionality described in FIG. 10. FIG. 11 is an electrical schematic diagram showing a different embodiment of the motor auto-reversing circuitry of the drip-free electric material dispensing device of the present invention. The functionality of motor control circuitry 230 is similar to that described in FIG. 10. Those who are skilled in the art will further appreciate that most portable electrical tools are battery powered and therefore utilize direct current (DC) motors. A typical embodiment will reverse the direction of a DC motor by reversing the voltage polarity to its terminals, and will vary the speed of a DC motor by varying the magnitude of the voltage applied to its terminals. However, various embodiments may utilize various motors and control systems that achieve the desired effect described above. For example, an embodiment of the drip-free electric material dispensing device may utilize a power cord instead of a battery pack, and it may be possible that the motor operates on alternating current (AC.) Accordingly, different motor control circuits may be designed to accommodate these various embodiments.

Figure 12A:
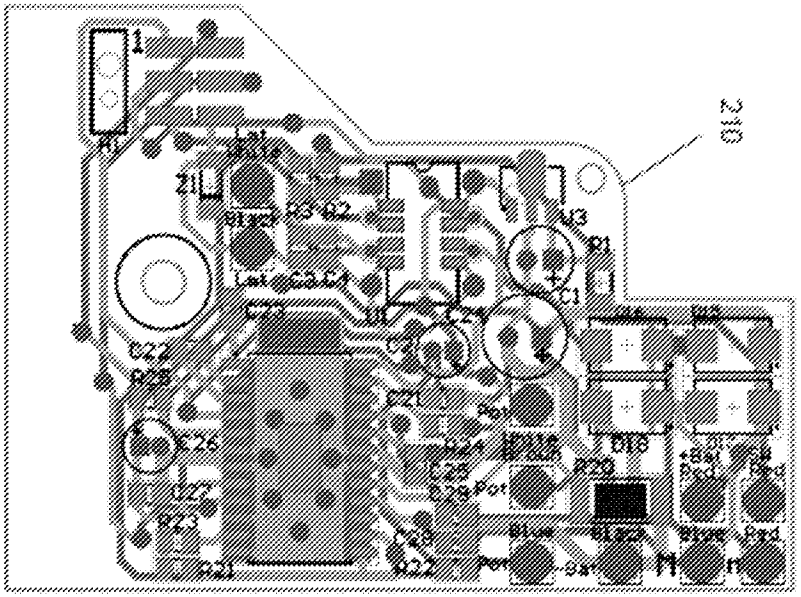
FIG. 12A is a top plan view of a printed circuit board for the motor auto-reversing circuitry of the drip-free electric material dispensing device according to certain aspects of the present invention.

Referring now to FIG. 12A, a top plan view of an embodiment of the printed circuit board for the motor auto-reversing circuitry of the drip-free electric material dispensing device. Printed circuit board 210 is designed to accommodate integrated circuit packages, power semiconductors, other discrete electrical components, and associated wiring as necessary to enable the electrical circuit that was described in FIGS. 10 and 11. Those who are skilled in the art will appreciate that printed circuit boards may vary greatly in their particular design, being single sided, dual sided, or possibly multi-layer. Printed circuit board designs may also vary depending on the method used to assemble and mount components thereto. This view is a typical embodiment of a design for a printed circuit board 210 that may be used to enable a typical motor control circuit 220, 230 as described in FIGS. 10 and 11.

Figure 12B:
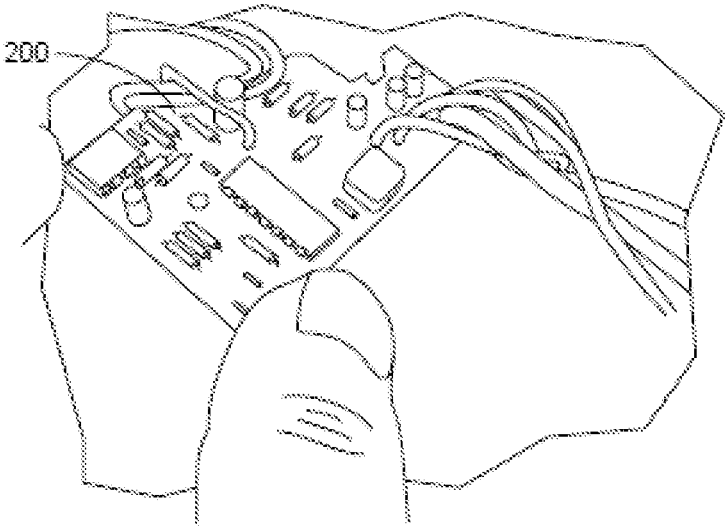
FIG. 12B is a top perspective view of the electrical circuit board for the motor auto-reversing circuitry of the drip-free electric material dispensing device according to certain aspects of the present invention.

FIG. 12B is a top perspective view of an embodiment of the electrical circuit board for the motor auto-reversing circuitry of the drip-free electric material dispensing device 100. In this view, the design of printed circuit board 210 has been incorporated into motor control board 200. Various wires associated with power supplies, control switches, sensors, and motor 103 are seen connected to motor control board 200, which is then contained within drip-free electric material dispensing device 100. Those who are skilled in the art will appreciate that various methods may be utilized for assembling and mounting motor control board 200 in a particular embodiment, and that various design precautions must be included as necessary to adequately insulate motor control board 200 from the environment exterior to drip-free electric material dispensing device 100 while also affording adequate ventilation, heat removal, mechanical robustness, and so on.

Figure 13:
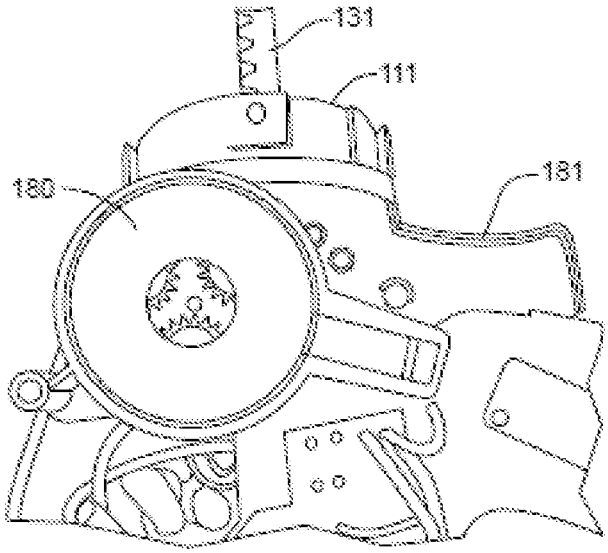
FIG. 13 is a top perspective view of the plunger rack gear drive transmission assembly of the drip-free electric material dispensing device according to certain aspects of the present invention.

Referring now to FIG. 13, a top perspective view of an embodiment of the plunger rack gear drive transmission assembly of the drip-free electric dispensing device. Gear drive transmission assembly 180 is contained within gearbox assembly 101 on drip-free electric dispensing device 100, having the purpose of matching the relatively high speed of motor 103 with the relatively low speed required of plunger assembly 130 during normal operation, while also translating the rotary motion of motor 103 into the linear motion required of rack 131 as necessary to drive plunger assembly 130. Those who are skilled in the art will appreciate that motor 103, typically being a small DC motor, is able to generate peak torque and operate at maximum efficiency while driven at a speed that may be on the order of several thousand rpm, while the speed required of plunger assembly 130 may be on the order of only inches per minute. At the same time, the force that plunger assembly 130 applies to material cartridge piston 122 may be on the order of tens or hundreds of pounds as necessary to expel highly viscous materials from material cartridge 120 through material cartridge nozzle 121. Under normal operations, rack 131 is directly engaged with gear drive transmission assembly 180. However, to facilitate the loading and unloading of material cartridge 120 from cartridge housing 110, it may be desirable for a user to rapidly move rack 131 in an axial direction, either forward or back. The need for this may be appreciated by realizing that under some conditions, a user may desire to remove a partially expensed material cartridge 120 and then reload it at a later time. Accordingly, gear release mechanism 181 enables the disengagement of rack 131 from gear drive transmission assembly 180.

Figure 14A:
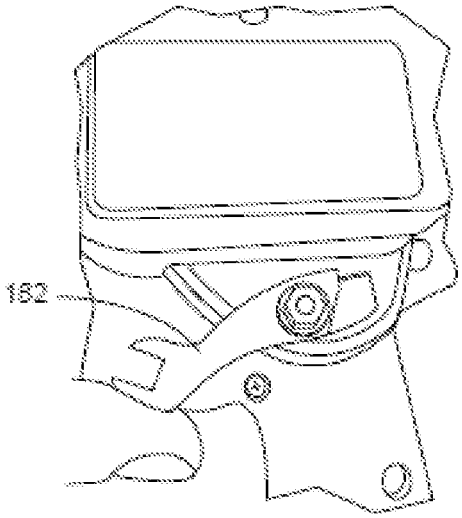
FIG. 14A is a side perspective view of the mechanical release mechanism shown in the normal position for the plunger rack gear drive transmission assembly of the drip-free electric material dispensing device according to certain aspects of the present invention.
Figure 14B:
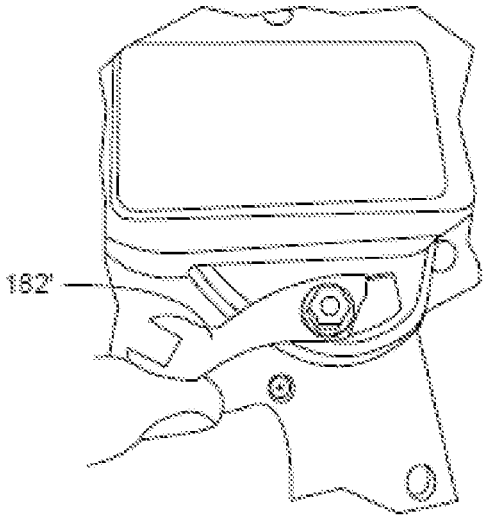
FIG. 14B is a side perspective view of the mechanical release mechanism shown in the actuated position for the plunger rack gear drive transmission assembly of the drip-free electric material dispensing device according to certain aspects of the present invention.

FIGS. 14A and 14B illustrate a side perspective view of an embodiment of the mechanical release mechanism of the drip-free electric material dispensing device according to an embodiment of the present invention. Referring to FIG. 14A, which shows gear release lever 182 in its normal state with rack 131 engaged with gear drive transmission assembly 180. In the normal condition, as shown in FIG. 14A, mechanical spring force engages rack 131 with gear drive transmission assembly 180. Referring now to FIG. 14B, when the user applies pressure to gear release lever 182, causing it to move upward as shown, an internal linkage between gear release lever 182' and gear drive transmission assembly 180 disengages rack 131, thereby allowing the free movement of rack 131 in the forward or reverse direction. When the user releases the pressure on gear release lever 182', mechanical spring force returns it to the normal position thereby reengaging gear drive transmission assembly 180 with rack 131.

Figure 17A:
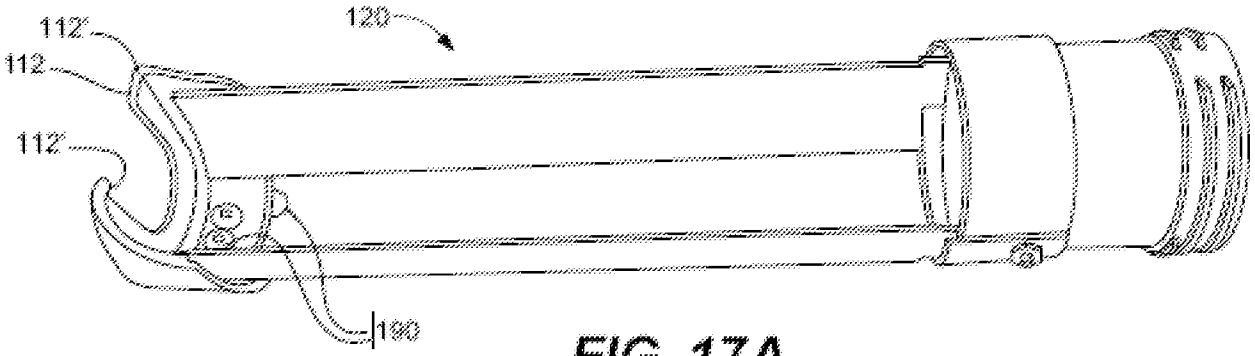
FIG. 17A is a side perspective view of a cartridge housing of the drip-free electric material dispensing device according to certain aspects of the present invention, shown to have the cartridge housing tips curving back towards the cartridge containing area to keep a cartridge within the cartridge housing tight within the cartridge housing during use, and adjustable screws at the proximal end of the cartridge housing that can be adjusted to help keep a cartridge properly positioned within the cartridge housing.
Figure 17B:
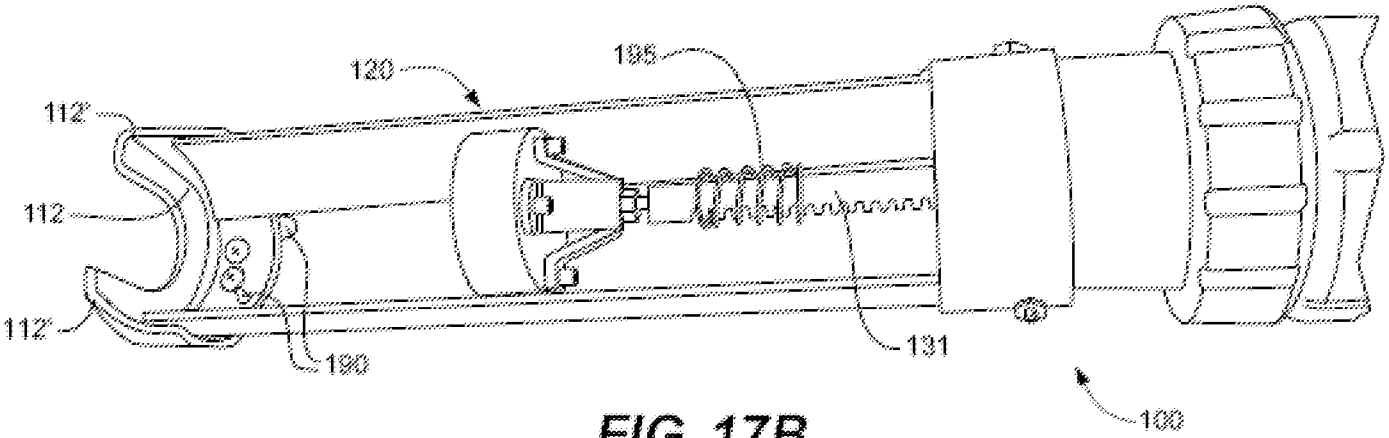
FIG. 17B is a side perspective view of the cartridge housing in FIG. 17A attached to the drip-free electric material dispensing device and the plunger assembly of the drip-free electric material dispensing device having a spring wrapped around the rack to facilitate the reverse of the plunger assembly according to certain aspects of the present invention.

Referring now to FIGS. 17A and 17B, the cartridge housing 110 has a curved tip configuration 112' at the cartridge housing end plate 112. The curved tip configuration 112' of the cartridge housing end plate 112 has the cartridge housing end plate 112 curving back towards the material cartridge 120 to keep the material cartridge 120 pushed down and in proper alignment within the cartridge housing 110 as the plunger assembly 130 is driven forward and back via rack 131. In this embodiment, rack 131 is driven forward and back by the rack gear drive transmission assembly of the drip-free electric material dispensing device 100, as shown in FIG. 17B.

FIGS. 17A and 17B also show one or more pointed screws 190 at the cartridge housing end plate 112. The one or more pointed screws 190 are configured to operably engage the material cartridge 120 when inserted within the cartridge housing 110, such that the material cartridge 120 is kept properly aligned. In some aspects, the pointed screws 190 operably engage the material cartridge 120 by at least partially inserting into the housing of the material cartridge 120. In some aspects, the pointed screws 190 are angled such that the tips of the pointed screws 190 point towards the cartridge housing end plate 112, such that when the plunger assembly 130 is driven back via rack 131 the material cartridge 120 is held tight within the cartridge housing 110 towards the cartridge housing end plate 112, which helps release the pressure of the plunger assembly 130 against the material cartridge piston 122 of the material cartridge 120.

Referring now to FIG. 17A, a compression spring 195 may be contained around the rack 131 of the plunger assembly 130. In some aspects, when one pulls the rack 131 back to the starting position, the rack 131 will be pulled back until it stops at the compression spring 195. During operation, when the rack 131 is driven forward and then stopped, the compression spring 195 will facilitate the reverse of the plunger assembly 130 against the material cartridge piston 122 of the material cartridge 120. In some aspects, the compression spring 195 will facilitate reversal of at least about 0.125 inches to about 1 inch, in some aspects at least about 0.25 to about 0.75 inch, most preferably at least about 0.25 to about 0.5 inches.

Figure 15B:
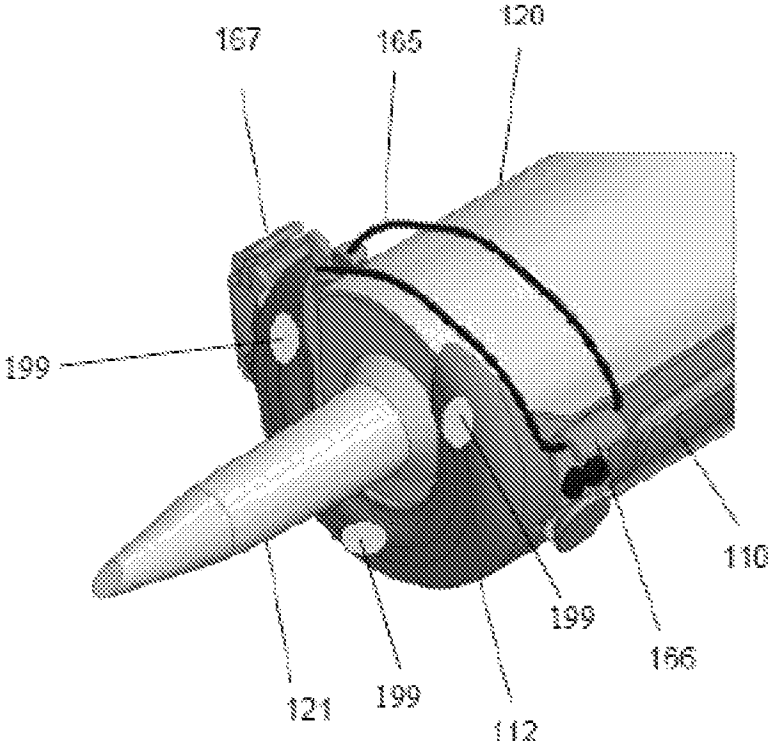
FIG. 15B is a front left side perspective view of the alternative embodiment of the cartridge locking mechanism in FIG. 15A.
Figure 15A:
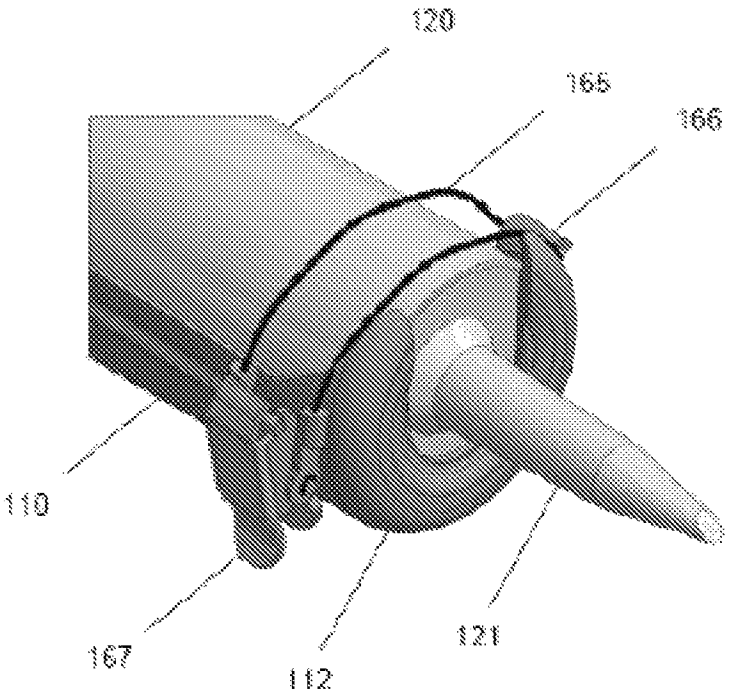
FIG. 15A is a front right side perspective view of the drip-free electric material dispensing device according to certain aspects of the present invention, showing an alternative embodiment of the cartridge locking mechanism.

In some aspects, the drip-free electric material dispensing device 100 may have a light source means 199 that enables the user to see where the caulk is being applied during normal operation. In some aspects, as shown in FIG. 15B, the light source means 199 is one or more wireless LED lights at the cartridge housing 110. In some aspects, the light source means 199 is one or more wireless LED lights at the cartridge housing 110 proximate the housing end plate 112, such that the light shines in the same direction as the flow of the caulk material. In some aspects, the light source means 199 is one or more wireless LED lights at the cartridge housing 110 proximate the cartridge housing end plate 112 at each of the curved tip configurations 112', in some aspects at the bottom portion of the cartridge housing end plate 112 proximate the opposite end of the opening, and in some aspects in each of the curved tip configurations 112' and at the bottom portion of the cartridge housing end plate 112.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A device for dispending a viscous material from a tubular cartridge, the device comprising:

a housing;

a motor supported by the housing;

a cradle extending from the housing, the cradle adapted to support a tubular cartridge of a viscous material, the tubular cartridge having an engagement end having a plunger moveable within the tubular cartridge to move the viscous material from the tubular cartridge from a dispensing end;

a rod supported by the housing, the rod having a proximate end coupled to the motor and a distal end, the rod moveable in a first direction and a second direction;

a plunger assembly coupled to the distal end of the rod, the plunger assembly having two or more tabs that are configured to be at least partially extended into the plunger of the tubular cartridge when the plunger assembly is moved into engagement with the plunger of the tubular cartridge of the viscous material;

a trigger supported by the housing and moveable in a first direction and a second direction; and a controller coupled to the motor and the trigger, the motor operable to move the rod having the plunger assembly coupled to the distal end into engagement with the plunger of the tubular cartridge and push the plunger within the tubular cartridge in a forward direction towards the dispending end such that a portion of the viscous material dispenses from the dispending end of the tubular cartridge when the controller senses movement of the trigger in the first direction, and the motor operable to move the rod having the plunger assembly coupled to the distal end in a reverse direction away from the dispending end when the controller senses movement of the trigger in the second direction;

wherein the two or more tabs of the plunger assembly remain at least partially extended into the plunger within the tubular cartridge when the rod moves in the reverse direction, such that the plunger of the tubular cartridge moves within the tubular cartridge by the plunger assembly in the reverse direction towards the engagement end to retract a portion of the viscous material back into the tubular cartridge.

2. The device of claim 1, wherein the trigger moves in the second direction when a user releases pressure on the trigger in the first direction.

3. The device of claim 1, wherein the plunger assembly moves ⅛ inch to 2 inches in the reverse direction when the controller senses movement of the trigger in the second direction.

4. The device of claim 1, wherein the plunger assembly moves ¼ inch to 1 inch in the reverse direction when the controller senses movement of the trigger in the second direction.

5. The device of claim 4, wherein the plunger assembly moves the plunger ¼ inch to 1 inch in the reverse direction when the controller senses movement of the trigger in the second direction.

6. The device of claim 1, wherein the cradle comprises a cartridge locking mechanism that limits movement of the tubular cartridge within the cradle in the forward or reverse directions.

7. The device of claim 1, wherein the cartridge locking mechanism pivots with respect to the cradle.

8. The device of claim 1, further comprising one or more light sources at the dispending end of the cradle.

9. The device of claim 1, wherein the two or more tabs extend in an outward radial direction form a center axis of the plunger assembly.

10. The device of claim 1, wherein a second motor speed in the reverse direction is greater than a first motor speed in the forward direction.

11. The device of claim 10, wherein the second motor speed in the reverse direction is between 10,000 rpms and 25,000 rpms.

12. The device of claim 11, wherein the first motor speed in the forward direction is between about 2,500 rpms and about 8,000 rpms.

13. The device of claim 10, wherein motor is operable in the reverse direction at the second motor speed for a predetermined amount of time from when the controller senses movement of the trigger in the second direction.

14. The device of claim 13, wherein the predetermined amount of time corresponds to a retracted distance of the rod having the plunger assembly coupled to the distal end in the reverse direction that is between ¼ inch to 1 inch.

15. The device of claim 1, wherein the plunger assembly further comprises a plunger spring proximately located between a plunger cone and a plunger housing, wherein the plunger spring is configured to exert a bias force on the plunger cone in the forward direction, whereby the bias force exerted on the plunger cone by the plunger spring provides an interior void proximately located between a back face of the plunger cone and a front face of the plunger housing.

16. The device of claim 15, wherein the plunger cone is configured to force the two or more tabs in an outward radial direction from the plunger assembly when the plunger cone is pushed by the plunger of the tubular cartridge in the reverse direction and into the interior void.

17. The device of claim 16, wherein the plunger housing is configured to operably receive the plunger cone when the plunger cone is pushed by the plunger of the tubular cartridge in the reverse direction.

18. The device of claim 15, wherein the back face of the plunger cone and the front face of the plunger housing each have an angular cone angle between about 25 degrees and about 80 degrees.

19. The device of claim 18, wherein the angular cone angle of the back face of the plunger cone and the front face of the plunger housing are approximately the same, such that the plunger cone is configured to force the two or more tabs in an outward radial direction when the plunger cone is pushed by the plunger of the tubular cartridge in the reverse direction towards the plunger housing and into the interior void.

20. The device of claim 1, further comprising a gear release mechanism that operably releases the plunger assembly from a gear transmission assembly to allow a user to move the plunger assembly in either the forward or reverse directions without use of the trigger.

* * * * *